US006419571B2

(12) United States Patent
Ueno

(10) Patent No.: US 6,419,571 B2
(45) Date of Patent: Jul. 16, 2002

(54) POLISHER AND GROUND PAPER FOR POLISHERS

(75) Inventor: Makoto Ueno, Miyagi (JP)

(73) Assignee: Tateo Uegaki, Sendai (JP)

( * ) Notice: Subject to any disclaimer, the term of this patent is extended or adjusted under 35 U.S.C. 154(b) by 0 days.

(21) Appl. No.: 09/761,866

(22) Filed: Jan. 17, 2001

(30) Foreign Application Priority Data

Jan. 18, 2000 (JP) ..... 2000-013984

(51) Int. Cl.[7] ..... B24D 11/00

(52) U.S. Cl. ..... 451/523; 451/495; 451/524; 451/525; 451/526; 451/530; 451/539; 451/913

(58) Field of Search ..... 451/495, 523, 451/524, 525, 526, 530, 539, 913

(56) References Cited

U.S. PATENT DOCUMENTS 5,662,519 A * 9/1997 Arnold ..... 451/525
6,120,365 A * 9/2000 Johnson ..... 451/495

* cited by examiner

*Primary Examiner*—Joseph J. Hail, III
*Assistant Examiner*—Shantese McDonald

(74) *Attorney, Agent, or Firm*—Burr & Brown

(57) ABSTRACT

A polisher for polishing a repair surface to a predetermined shape and a ground paper for polishers are provided. The polisher of the present invention includes a substrate portion (30) for holding an abrasive on a surface opposite to a repair surface, a holding plate (2) provided in parallel to the substrate portion with a predetermined space therebetween, and elastic members (3) interposed between the substrate portion (30) and the holding plate (2). The substrate portion (30) has a first face plate portion (4) fixed to the holding plate (2) with a predetermined space therebetween and second face plate portions (5) which are connected to respective end portions of the first place portion (4) and are rotatable about connection lines as axes, connecting them and the first face plate portion (4). The second face plate portions (5) are rotatably provided in a predetermined range from a position where they become flush with the first face plate portion (4) in a direction that they approach the holding plate (2). The ground paper for polishers of the present invention is adhered to a surface facing the repair surface of the substrate portion (30), a plurality of through holes (31) are formed in the ground paper, and some of the through holes are located at positions corresponding to the boundaries between the first face plate portion (4) and the second face plate portions (5). According to the present invention, there are provided a polisher which can polish the repair surface flat by simple operation and a ground paper for polishers.

15 Claims, 15 Drawing Sheets

POLISHER AND GROUND PAPER FOR POLISHERS

BACKGROUND OF THE INVENTION

1. Field of the Invention

The present invention relates to a polisher for polishing a repair surface to a predetermined shape and a ground paper for polishing to be used for polishers.

2. Description of the Related Art

As for the procedure of repairing scratches and depressions on the coated surface of a vehicle such as an automobile, as shown in FIG. 21, a primer 51, a surfacer 52 and a paint 53 formed on a steel plate 50, are first removed and a depression is filled with a slightly excessive amount of putty P.

As shown in FIG. 22, the surface filled with the putty 1 (damaged portion) is polished to be flush with the surface of the body. In this step, coarse-grained to fine-grained sandpapers are used to polish the surface P1 filled with putty into flat. It is not too much to say that the workmanship of this step determines final repair. Note that the surface P1 filled with putty may be simply referred to as "putty surface P1" or "repair surface P1" in the following description.

In this polishing step, to reduce time and labor for this polishing, a mechanical sander 100, which is powered by compressed air or electricity, is used. This sander 100 has a movable portion 55 which makes a predetermined motion such as reciprocation or circular motion along the repair surface and a polisher 54, held by the movable portion 55, for polishing the repair surface P1. Note that a polishing surface opposite to the repair surface P1 of the polisher 54 is a flat surface and sandpaper (ground paper) which is an abrasive is affixed to the flat surface.

To use this sander 100, the sander 100 is held by both hands and the polishing surface of the polisher 54 provided on the sander 100 is applied to the repair surface P1 for polishing. Since the polishing surface in contact with the repair surface P1 is flat, the repair surface P1, which is a convex surface, can be polished flat by using this. However, when the repair surface P1 was actually polished, it could not always be polished flat.

The reason for this is that the polishing surface of the polisher 54 is deformed by convex and concave portions formed on the putty surface by the impressions of a trowel used to fill the putty P, thereby impairing flatness. Therefore, it takes much time to obtain a well polished surface and the contact pressure of the polisher 54 against the putty surface P1 must be finely controlled, which requires the skill of an experienced engineer.

To overcome this inconvenience, therefore, polishing has been conventionally made based on the following polishing theory. The polishing theory is that point polishing for polishing only convex portions of the uneven surface formed by the impressions of the trowel with a small polishing area is first made on the putty surface P1 repeatedly to make the putty surface P1 a gently rolling surface as a whole. Subsequently, face polishing is made on the entire putty surface P1 (rolling surface) from which the convex portions of the uneven surface have been removed with a large polishing area.

Thus, by changing the polishing area stepwise, the putty surface P1 having convex and concave portions formed by the impressions of the trowel or the like can be polished flat. When point polishing is carried out continuously, this results in linear polishing. That is, face polishing is carried out after linear polishing substantially.

Stated more specifically based on the actual polishing method, only an edge portion 56 (corner edge portion) of the polisher 54 held by the sander 100 is applied to the repair surface P1 as shown in FIG. 22 to carry out linear (point) polishing. Like this, when the edge portion 56 of the polisher 54 is used, the contact surface between a convex portion on the putty surface P1 and the polisher 54 becomes linear (point) and the convex portions can be polished one by one.

Subsequently, the putty surface P1 is polished flat by linear (point) polishing using the edge portion 56 by operating the sander 100 such that the entire polishing surface of the polisher 54 comes into contact with the putty surface P1 whose convex and concave portions have been polished. Since convex and concave portions formed on the putty surface P1 by the impressions of the trowel or the like have already been removed by linear polishing as described above, the putty surface P1 can be polished flat without impairing the flatness of the polishing surface of the polisher 54.

Thus, a flat and well-polished surface can be easily obtained without using advanced skill theoretically. In addition, as the above polishing theory is a rational technique for obtaining a flat polished surface, a well-polished surface can be obtained within the minimum time.

However, at the time of polishing using the edge portion 56 of the polisher 54, the contact area of the polisher 54 with the repair surface P1 is extremely small as a matter of course and the stability of the polisher 100 is impaired. Therefore, to obtain a well polished smooth surface, an operator must hold the sander 100 (polisher 54) at an appropriate angle with respect to the putty surface P1, thereby requiring advanced skill in fact.

Further, there arises a problem in that the sandpaper of the edge portion 56 wears away quickly. This is a phenomenon that is often seen in the sander 100 for polishing the putty surfer P1 in a short period of time.

SUMMARY OF THE INVENTION

The present invention has been made in view of the above, and therefore, an object of the present invention is to provide a polisher which can polish a repair surface flat by simple operation within a short period of time. Also, an object of the present invention is to provide a polisher in which local excessive abrasion of the sandpaper can be suppressed. Also, an object of the present invention is to provide a ground paper for polishers with which working efficiency thereof can be enhanced.

According to a first aspect of the present invention, there is provided a polisher, comprising: a substrate portion 30 for holding an abrasive on a surface opposite to a repair surface; a holding plate 2 provided in parallel to the substrate portion 30 with a predetermined space therebetween; and elastic members 3 interposed between the substrate portion 30 and the holding plate 2, wherein: the substrate portion 30 has a first face plate portion 4 fixed to the above holding plate 2 with a predetermined space therebetween and second face plate portions 5 which are connected to end portions of the first face plate portion 4 and are rotatable about connection lines as axes, connecting them and the first face plate portion 4; and the second face plate portions 5 is provided rotatably in a predetermined range from a position where they become flush with the first face plate portion 4 in a direction that they approach the holding plate 2.

According to the polisher of the present invention, firstly, concave and convex portions formed on a repair surface by the impressions of a trowel or the like are polished with a small polishing surface consisting of only the second face plate portion and then polished with a large polishing surface consisting of the second face plate portions and the first face plate portion. That is, point polishing is carried out with the second face plate portion, and then face polishing is carried out using the first face plate portion and the second face plate portions, simultaneously.

Thus, unlike polishing using an edge portion, a stable operation feeling is obtained in spite of point polishing as the polisher is in face contact with the repair surface. Therefore, the repair surface can be polished flat with simple operation without requiring advanced skill. Sandpaper (ground paper) held on the polishing surface of the polisher is in face contact with the repair surface. Therefore, local excessive abrasion of the sandpaper can also be suppressed.

In this case, the second face plate portions 5 are desirably urged from the holding plate 2 side by the elasticity of the elastic members 3 located between the holding plate 2 and the second face plate portions 5 in a direction that they become flush with the first face plate portion 4.

In this case, the contact pressure of the second face plate portion against the repair surface is maintained at an appropriate level by using the elasticity of the elastic members. Therefore, a stable operation feeling is obtained at the time of polishing using the second face plate portion, thereby making it possible even for an inexperienced person to obtain a well-polished surface easily. Further, when an external force applied to the second face plate portion is removed, the surfaces of the second face plate portions and the surface of the first face plate portion become flush with each other, an operator can polish with the entire surface of the substrate portion without exchanging the polishing surface.

Also, the present invention may take a structure in which the first face plate portion 4 and the second face plate portions 5 each may be formed rectangular, and the long sides of the second face plate portions may be connected to the respective long sides of the first face plate portion 4. In this case, the second face plate portions 5 connected to the respective long sides of the first face plate portion 4 are preferably provided on both of the long sides of the first face plate portion 4.

In this case, the edge portion of the polisher corresponds to the second face plate portion, thereby being capable of linear-polishing using the second face plate portion, which is similar to the polishing in the prior art using an edge portion. When the second face plate portions are provided on the respective long sides of the first face plate portion, operation efficiency is improved without limiting the operation direction of the polisher.

Note that the surface area of each of the second face plate portions 5 is preferably made smaller than the surface area of the first face plate portion 5. In this case, the first face plate portion which does not move with respect to the holding plate contacts the repair surface in a wide range. Accordingly, the stability of the polisher improves at the time of face-polishing using both the first face plate portion and the second face plate portions.

Further, the second face plate portions 5 preferably have flexibility in a direction perpendicular to the longitudinal direction of the second face plate portions 5. In this case, preferably, a plurality of elastic members 3 are provided in the longitudinal direction of the holding plate 2 at predetermined intervals, and the second face plate portions 5 having flexibility are supported by the plurality of elastic members 3.

In this case, the second face plate portions are bent along the swelling of the entire repair surface so that concave and convex portions formed by the impressions of a trowel or the like on the swelling of the repair surface can be caught without fail. Note that when the second face plate portions are supported by the plurality of elastic members, the number of the elastic members is suitably selected to obtain desired flexibility easily.

Further, the movable range of each of the second face plate portions 5 can be set to a range from a position where it becomes flush with the first face plate portion 4 to a position where part of the second face plate portion 5 comes into contact with the side edge of the holding plate 2. With this, the movable range of the second face plate portion is limited to a desired range. Accordingly, when an inexperienced person operates the polisher within the movable range, a well-polished surface can be easily obtained.

The holding plate 2 can be attached to and detached from the movable portion 55 of a sander 100 having the movable portion 55 which can make reciprocation along the repair surface. In this case, there are exemplified as the mechanical sander a double action sander, straight sander, and the like. Note that the polisher of the present invention can be set on not only a mechanical sander but also a manual sander having a holding portion such as a grip for manual polishing.

According to a second aspect of the present invention, there is provided a ground paper 1 for polishing which is used for the above polisher, wherein the ground paper 1 is adhered to a surface facing the repair surface of the substrate portion 30, and a plurality of through holes 31 are formed in the ground paper 1, some of the through holes being located on the boundaries between the first face plate portion 4 and the second face plate portions 5.

Some of the through holes 31 can be made screw holes for attaching the ground paper 1 to the first face plate portion 4. Also, it may employ a structure in which dust collection passages 13 may be formed in the first and second face plate portions 4 and 5 at positions corresponding to the through holes 31 of the ground paper 1, and a dust collection means 3 may be connected to the dust collection passages 13.

In addition, the through holes 13 located at positions corresponding to the boundaries between the first face plate portion 4 and the second face plate portions 5 may be provided at positions for dividing the longitudinal direction of the ground paper 1 into almost three sections.

The through holes 13 located in the first face plate potion 4 may be provided at positions for dividing the longitudinal direction of the substrate portion 30 into almost 4 to 8 sections.

The dust collection means may be connected to a suction device using negative pressure as a suction source. In this case, dust generated in a gap between the repair surface and the substrate portion by polishing is sucked from the dust collection passages 13 and introduced into the suction device 33 having a negative pressure source efficiently.

Suction is carried out from the through holes 31 formed in the ground paper 1. Some of the through holes 31 are located at the boundaries between the first face plate portion and the second face plate portions, with the result that high dust collection efficiency may be obtained.

The reason therefor resides in that, even when either one of the face plate portions is contacted to the polishing surface, the other face plate portion floats from the polishing surface and dust can be collected powerfully from the floated portion because the boundaries between the first and second face plate portions 4 and 5 are angled.

BRIEF DESCRIPTION OF THE DRAWINGS

In the accompanying drawings

DETAILED DESCRIPTION OF THE PREFERRED EMBODIMENTS

Figure 1:
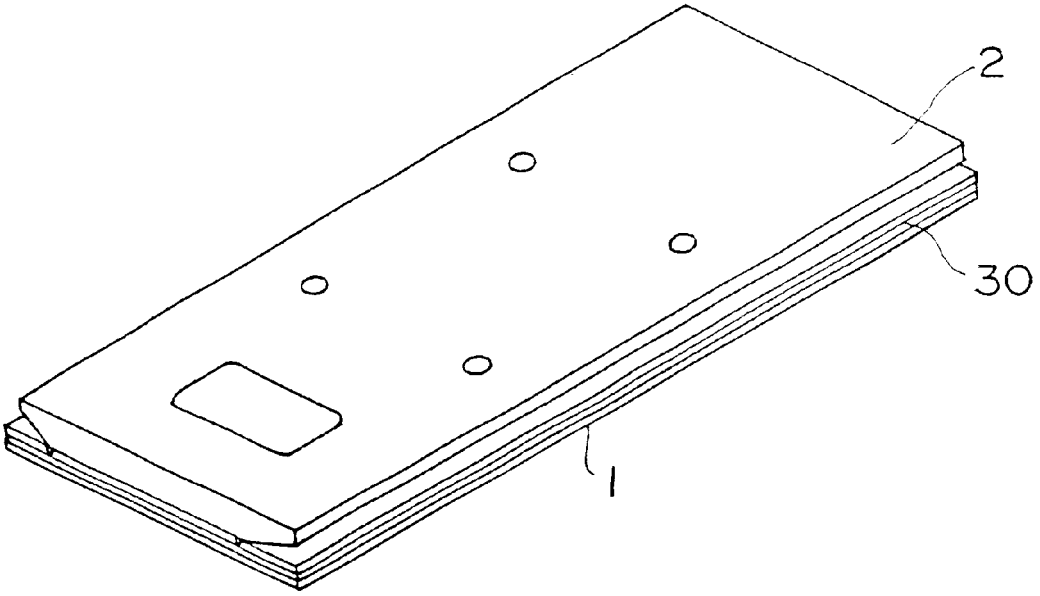
FIG. 1 is a perspective view of a polisher according to an embodiment of the present invention.
Figure 2:
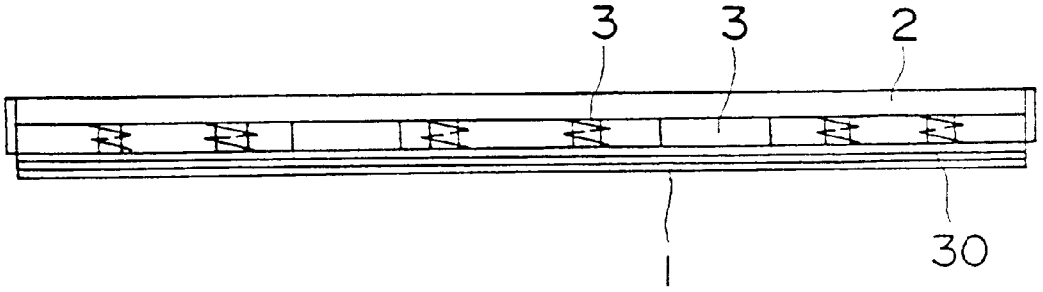
FIG. 2 is a side view of the polisher according to the embodiment of the present invention.
Figure 3:
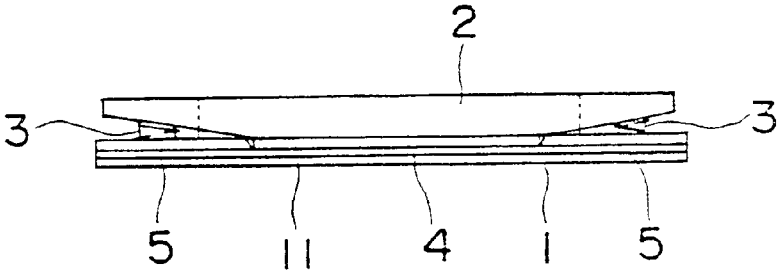
FIG. 3 is a front view of the polisher according to the embodiment of the present invention.
Figure 4:
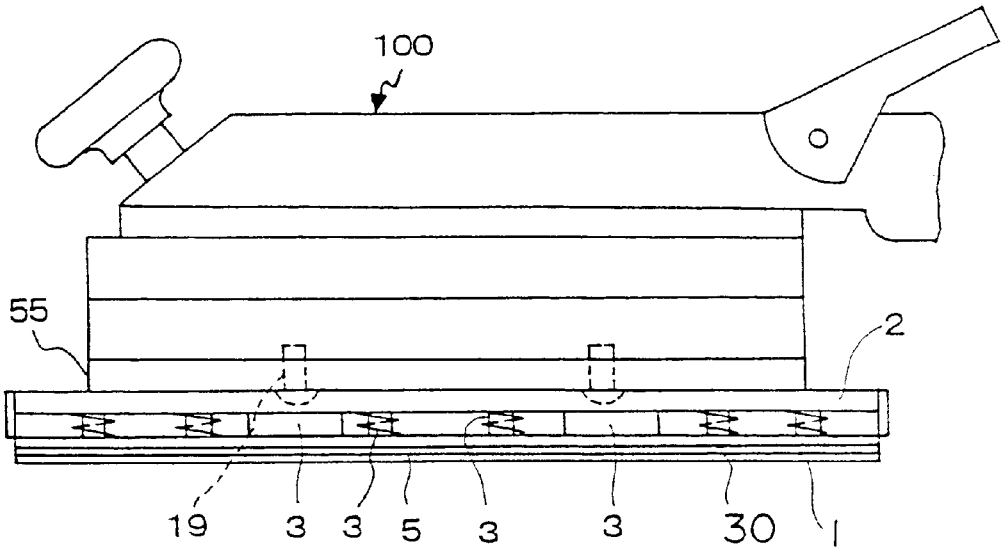
FIG. 4 is a side view of a ground paper for polishers according to an embodiment of the present invention set on a mechanical sander.
Figure 5:
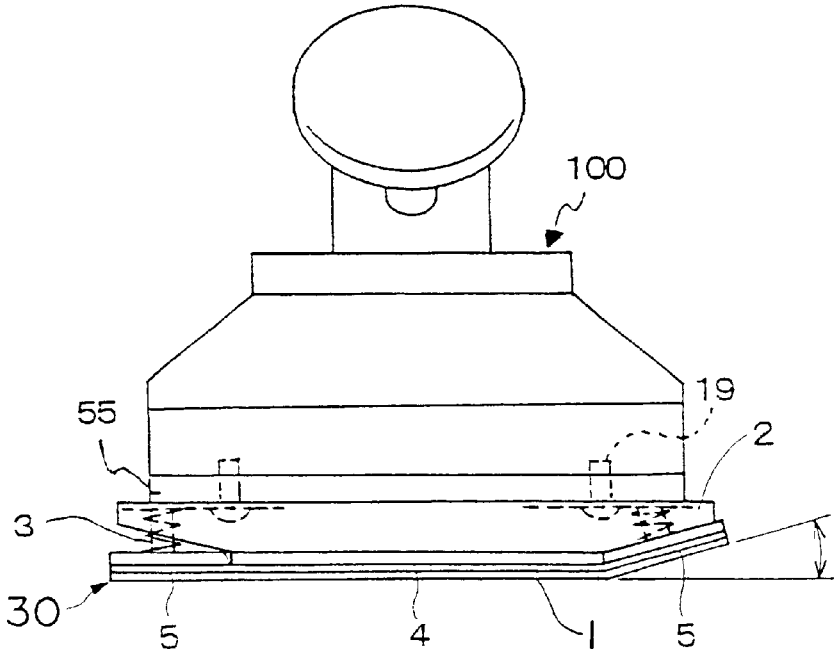
FIG. 5 is a front view of the ground paper for polishers according to the embodiment of the present invention set on the mechanical sander.

The present invention will be described in detail with reference to FIGS. 1 to 20.

A ground paper to be attached to a polisher will be described together with the polisher and polishing method.

In an embodiment of the present invention, a case where putty as a repair material and a surfacer are made from an ultraviolet curable material are used will be described. Prior to the explanation of the polisher of the present invention, a repair surface P1 to be polished will be first described.

To form the repair surface P1, a damaged portion is pretreated according to the damage of the damaged portion which is a repair surface (surface to be polished). The pretreatment includes the degreasing and removal of a coating film (may be referred to as "old coating film" hereinafter) formed on a vehicle and the removal of feather edges. The degreasing of the old coating film is a pretreatment which is carried out in most cases in a general repair method using no ultraviolet curable resin.

The removal of the old coating film is a treatment made on the old coating film at the damaged portion and therearound according to the damage of the damaged portion unlike degreasing. When the damage is a depression, the old coating film of the depression is removed in most cases. When the damaged portion is a linear cut, scratch, nail puncture, or the like as the old coating film has already been removed, it is judged whether the old coating film should be further removed according to the situation.

The removal of feather edges is carried out simultaneous with or after the removal of the old coating film to give a gentle slope from the surface of a steel plate or a surface of a resin part from which the old coating film has been removed toward the coated surface in order to improve adhesion of putty P. The inclination angle of the feather edge is generally about 27 to 54° The removal of the feather edge has been carried out in the prior art and is carried out in accordance with the prior art method in this embodiment.

Thereafter, the damaged portion and therearound from which the old coating film has been removed are preferably cleaned by blowing compressed air or the like and further degreased. Optionally, the damaged portion which has been pretreated is filled with a putty raw material composed of an ultraviolet polymerizable composition. Preferably, the ultraviolet polymerizable composition used as the putty raw material comprises an ultraviolet polymerizable prepolymer, ultraviolet polymerizable monomer, ultraviolet polymerization initiator and the like as essential ingredients, in addition to an ultraviolet polymerizable composition which is generally used as a putty raw material for automobiles, etc., and a sensitizer, pigment, filler, anti-foaming agent, surface modifier, solvent and the like as optional components.

In this embodiment, a damaged portion of the repair surface which has been pretreated is filled with the putty raw material as required. The putty raw material can be filled by the same method as in the prior art. Preferably, a slightly larger amount of the putty raw material than the volume to be filled is divided into several portions which are filled several times. For the first time of filling, an appropriate portion of putty is squeezed into the damaged portion with a plastic spatula. Further, the remaining amount of putty is divided into appropriate portions which are filled into the damaged portion with the plastic spatula such that air is not included in the putty raw material. After the putty raw material is filed, the portion filled with the putty raw material slightly rises from the surface of the old coating film and the rising of the putty filled portion from the old coating film is as tall as about 0.1 to 1 mm from the old coating film. The thickness of the portion filled with the putty raw material is generally 0.4 to 3 mm, depending on the thickness of the old coating film.

In this embodiment, the putty surface P1 is obtained in the damaged portion which has been pretreated as required by curing the putty raw material. When the volume of the putty raw material is slightly reduced by the curing of the putty, the rising of the putty from the surface of the old coating film may be slightly smaller than that before curing. To obtain the putty surface P1 which is a surface to be polished, the putty surface P1 may be formed not only by the above method, but also by filling a putty raw material containing no ultraviolet polymerizable composition. That is, a repair surface may be formed in accordance with the method of the prior art.

Thereafter, the polisher of the present invention is set on an existing sander to polish the putty surface P1 rising from the surface of the old coating film to make it flush with the surface of the old coating film. The mechanical sander holding the polisher of the present invention is an existing straight sander, orbital sander, or the like.

The straight sander is a type of vibrator which is powered by electricity, compressed air, or the like, and its movable portion 55 makes simple reciprocation on a plane parallel to the surface to be polished as its vibration direction. Therefore, a polisher set on the straight sander polishes while it makes simple reciprocation on the surface to be polished.

The orbital sander is a type of vibrator which is powered by electricity, compressed air, or the like, and its movable portion 55 makes an orbital motion on a plane parallel to the surface to be polished as its vibration direction. Therefore, the polisher held by the orbital sander polishes while it makes an orbital motion on the surface to be polished. These mechanical sanders include one for simply polishing a surface to be polished as well as a dust suction type one for polishing while dust generated by polishing is captured by a dust suction port provided at a predetermined location.

The polisher of the present invention held by these sanders 100 will be described in detail hereinafter. In this embodiment, a dust suction type straight sander having a dust suction port at a predetermined location is used as a sander provided with the polisher of the present invention.

The polisher of this embodiment comprises a substrate portion 30 for holding an abrasive on a surface opposite to the repair surface, a holding plate 2 provided in parallel to the substrate portion 30 with a predetermined space therebetween and elastic members 3 interposed between the substrate portion 30 and the holding plate 2. The substrate portion 30 has a first face plate portion 4 fixed to the holding plate 2 with a predetermined space therebetween and second face plate portions 5 which are connected to respective end portions of the first face plate portion 4 and are rotatable about connection lines as an axis, for connecting them and the first face plate portion 4.

The second face plate portions 5 are rotatably provided within a predetermined range from a position where they are flush with the first face plate portion 4 in a direction that they approach the holding plate 2.

Figure 6:
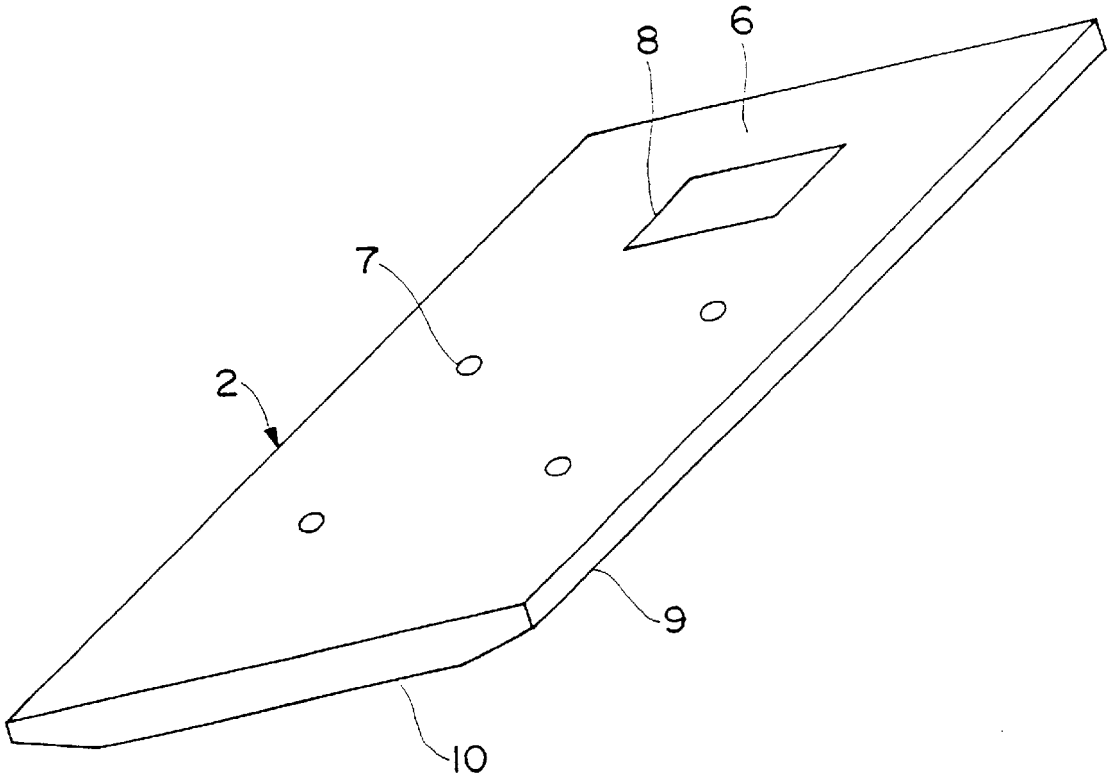
FIG. 6 is a perspective view of the holding plate portion of the polisher having the ground paper for polishers according to the embodiment of the present invention.

The holding plate 2 is produced by cutting an aluminum plate, polycarbonate plate, or the like into a rectangular plate form as shown in FIG. 6. Its face plate portion 6 has a plurality of bolt insertion holes 7 into which bolts 19 for fixing the holding plate 2 to the sander 100 and a dust collection port 8 which is connected to a dust suction port provided at a predetermined location of the sander 100. End portions on the long sides of the face plate portion 6 are bent downward (direction toward the side of the surface to be polished at the time of polishing). Further, end portions on the short sides of the face plate portion 6 are also bent downward. In the following description, "downward" denotes a direction toward the side of the surface to be polished at the time of polishing.

The substrate portion 30 which consists of the first face plate portion 4 and the second face plate portions 5 is provided below the holding plate 2 through the above elastic members 3. Lower end portions of the elastic members 3 and the substrate portion 30 are bonded together, and upper end portions of the elastic members 3 and the holding plate 2 are bonded together by an adhesive.

Figure 7:
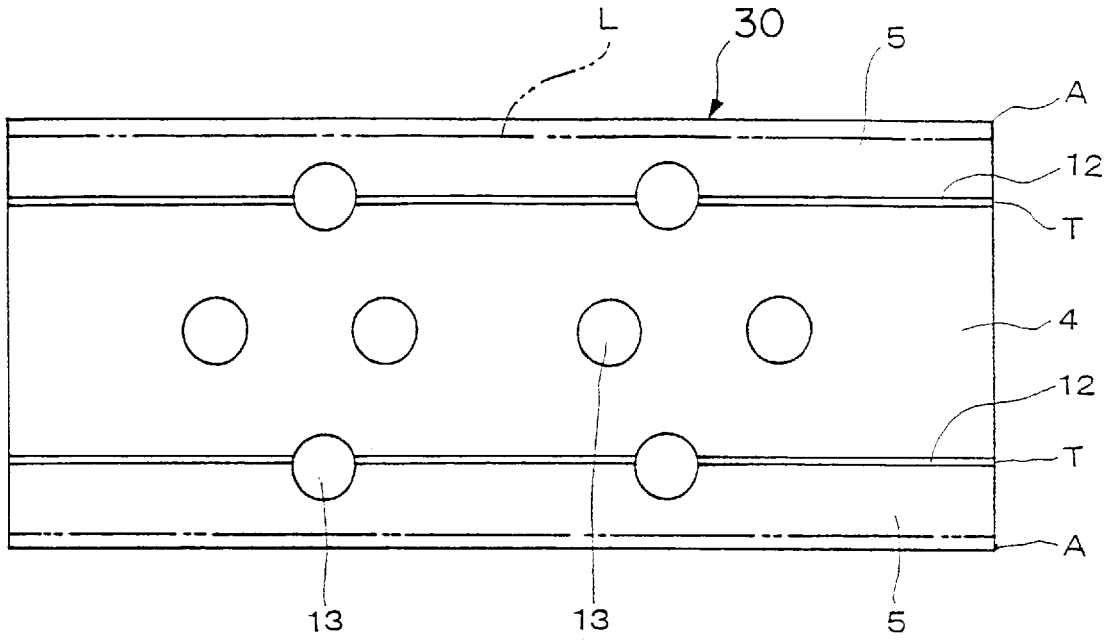
FIG. 7 is a top view of the substrate portion of the polisher having the ground paper for polishers according to the embodiment of the present invention.
Figure 8:
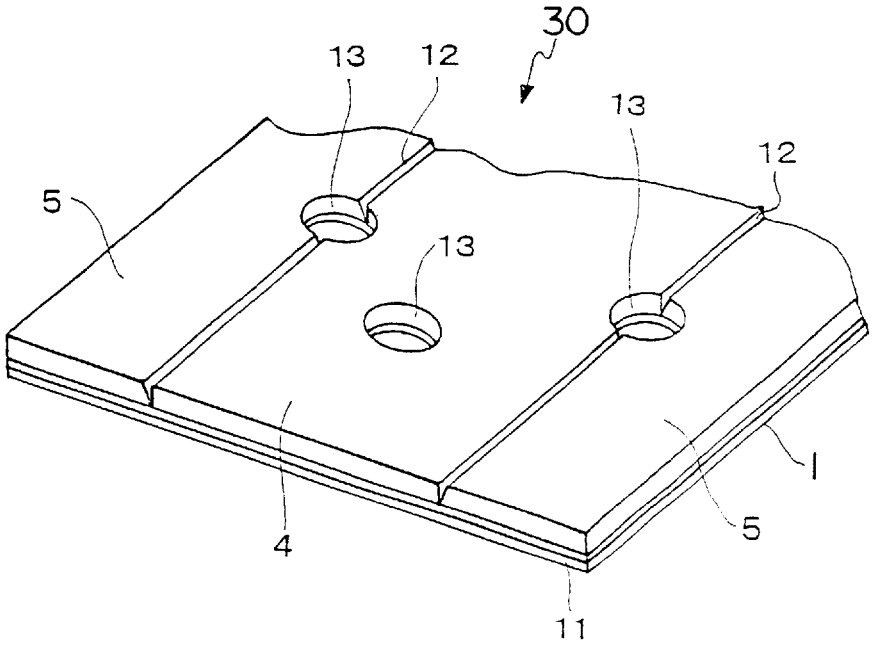
FIG. 8 is an enlarged view of key parts of the substrate portion of the polisher having the ground paper for polishers according to the embodiment of the present invention.

The substrate portion 30 consists of a single thick resin plate which is cut out as a rectangle having short sides slightly longer than the short sides of the holding plate 2, and an adhesive sheet 11 which is bonded to the under surface of the resin plate and detachably holds sandpaper as shown in FIG. 7 and FIG. 8.

A ground paper 1 is adhered to the entire surface of this adhesive sheet 11. The adhesive sheet 17 is not always necessary. When an adhesive layer (not shown) and release paper are provided on one side of the ground paper 1, the adhesive layer can serve as the adhesive sheet 11 by removing the release paper.

Figure 20:
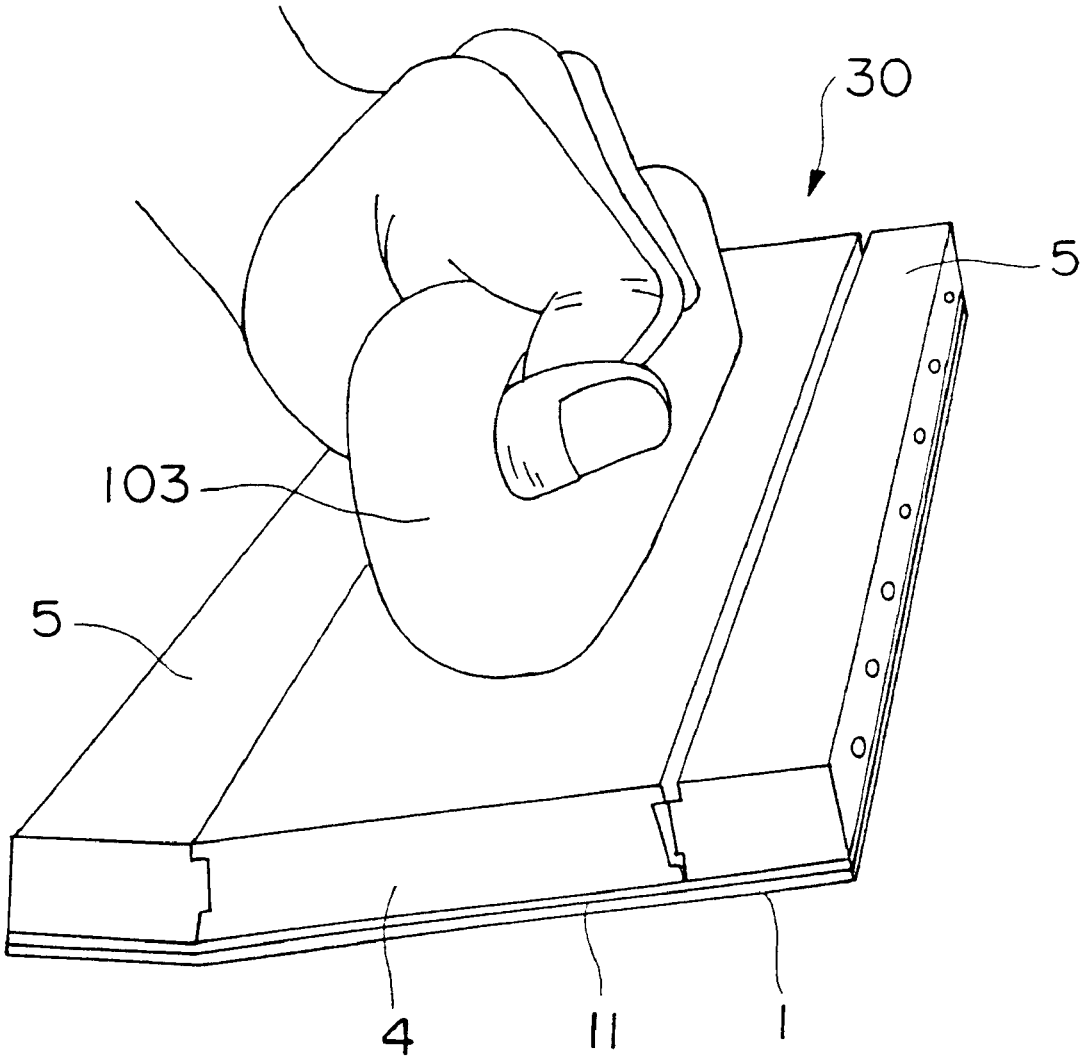
FIG. 20 is a perspective view of a manual polisher having the ground paper for polishers according to the embodiment of the present invention.
Figure 21:
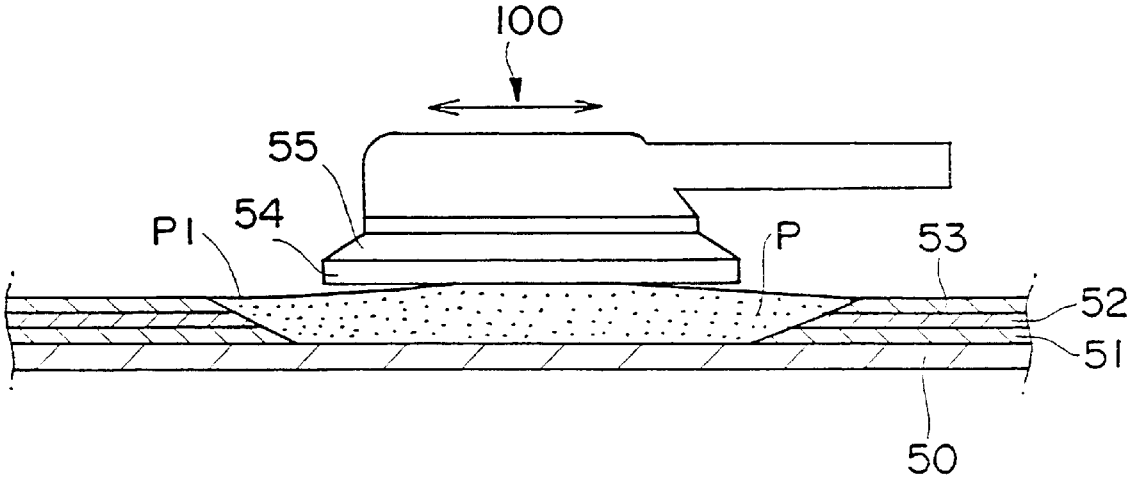
FIG. 21 is a diagram showing the polishing of a repair surface using a mechanical sander of the prior art.

In the above description, the sander which is operated by air pressure or electricity is described. FIG. 20 shows a manual sander. This type of sander has a grip 103 on the first face plate portion 4 so that it can be handled by one hand.

A detailed description is given of the ground paper 1 to be attached to the polisher.

The ground paper 1 is a so-called sandpaper and many holes 31 are formed in the ground paper 1. That is, as shown in FIGS. 15 to 17 which show three different ground papers 1 which differ from one another in size, some of the through holes 31 are located on the boundaries between the first face plate portion 4 and the second face plate portions 5, and are formed at positions for dividing the longitudinal direction of the substrate portion 30 into almost three sections.

The through holes 31 located on the first face plate portion 4 are formed at positions for dividing the longitudinal direction of the substrate portion 30 into almost 4 to 8 sections.

Figure 15:
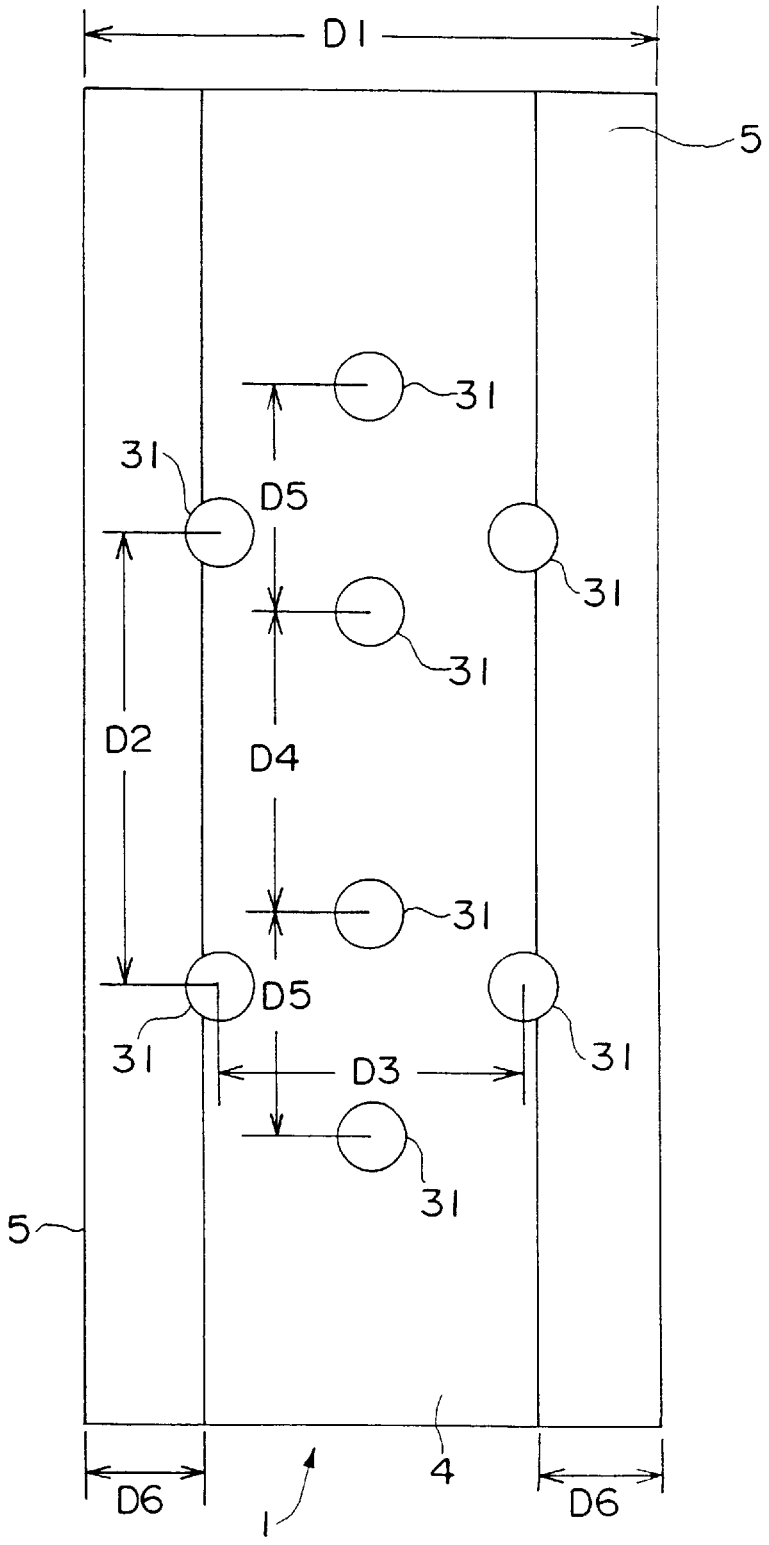
FIG. 15 is a plan view of a ground paper for polishers according to an embodiment of the present invention.

The width D1 of the ground paper 1 shown in FIG. 15 is 75 mm, the distance D2 between the through holes 31 which should be located on the boundary between the first face plate portion 4 and each of the second face plate portions 5 is 60 mm, the distance D3 between the through holes 31 which face each other is 40 mm, the distance D4 between a set of inner through holes 31 out of all the four through holes 31 formed at positions corresponding to the second face plate portions 5 is 40 mm, the distance D5 between these and the outer through holes 31 is 30 mm, and the width D6 of each of the two second face plate portions 5 is 16 mm. This is a standard sized ground paper for electric or manual sanders.

Figure 16:
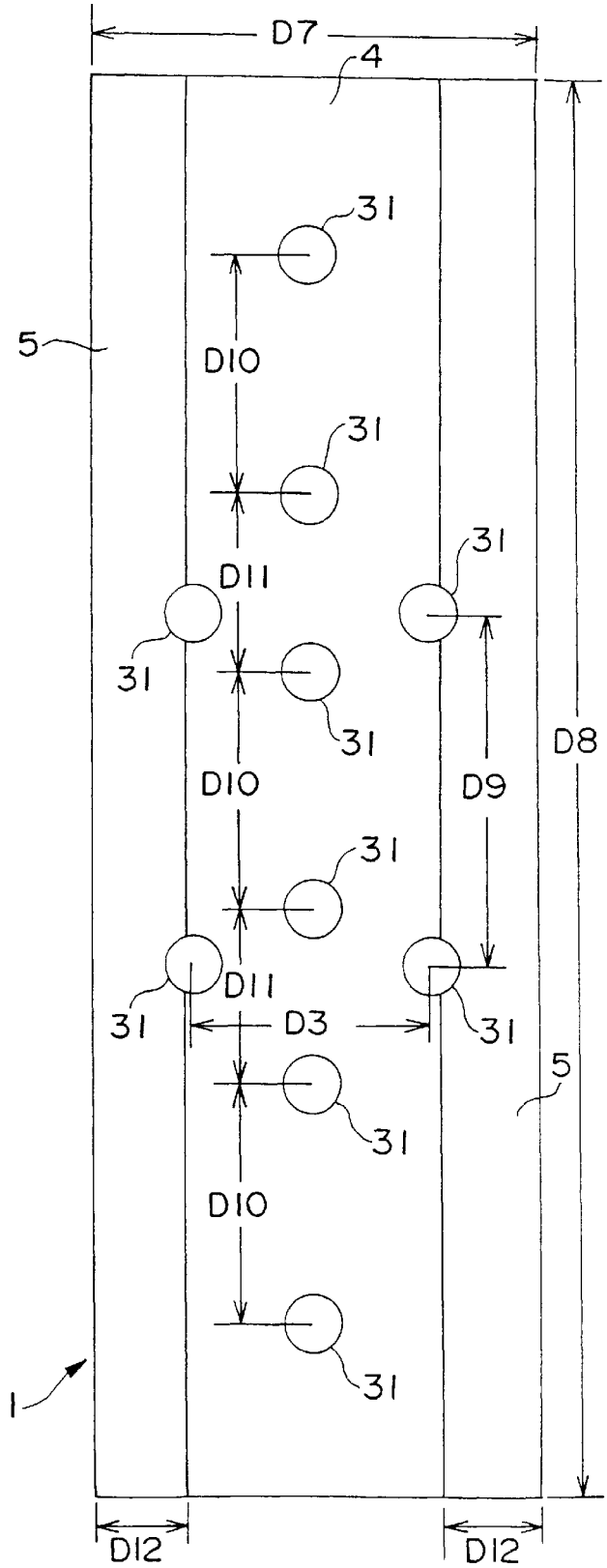
FIG. 16 is a plan view of a ground paper for polishers according to another embodiment of the present invention.
Figure 17:
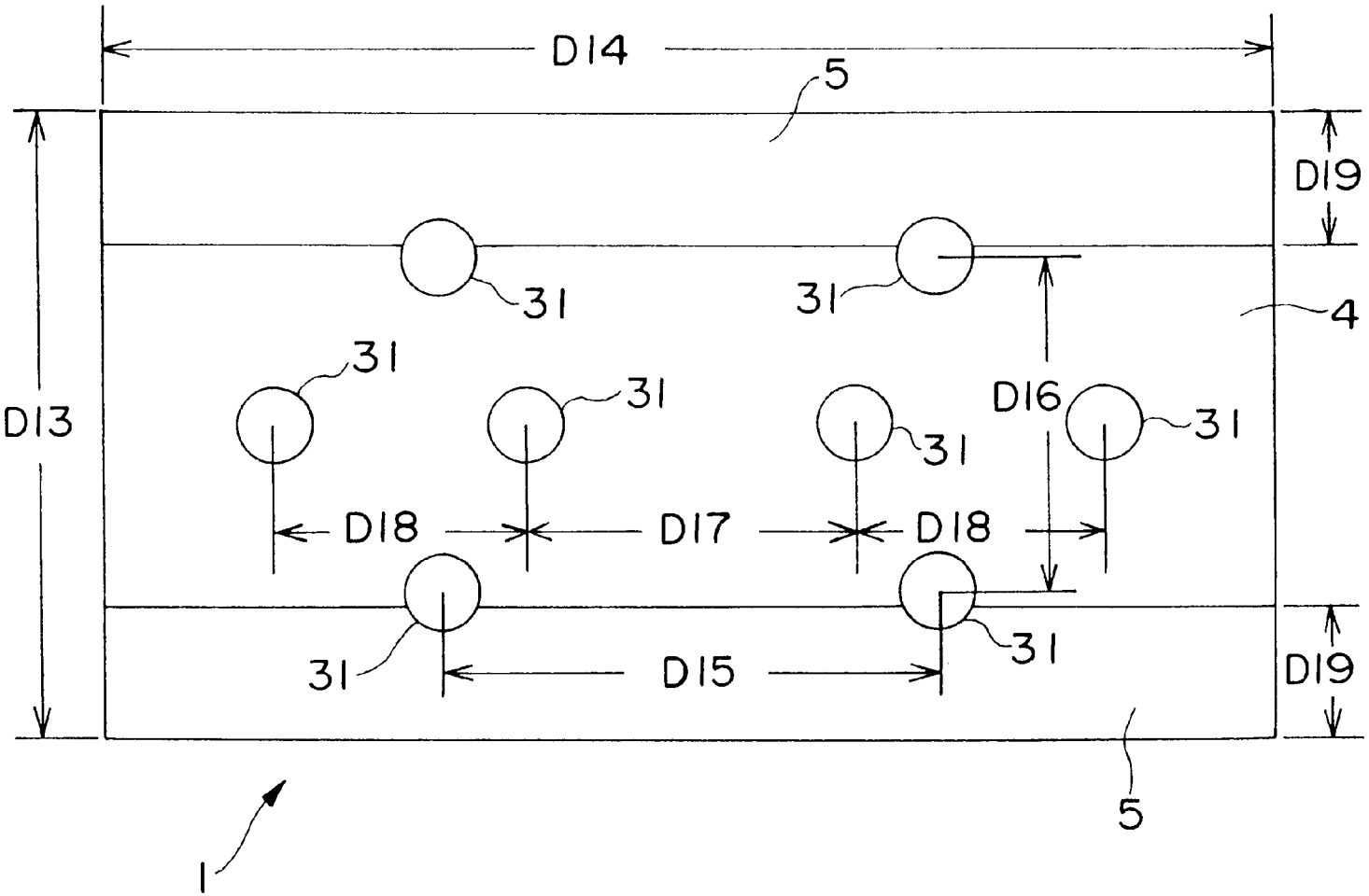
FIG. 17 is a plan view of a ground paper for polishers according to still another embodiment of the present invention.

The width D7 of the ground paper 1 shown in FIG. 16 is 75 mm, the length D8 of the ground paper 1 is 230 mm, the distance D9 between the through holes 31 which should be located on the boundary between the first face plate portion 4 and each of the second face plate portions 5 is 60 mm, the distance D3 between the through holes 31 which face each other is 40 mm, the distance D10 between a set of inner through holes 31 out of the six through holes formed at positions corresponding to the second face plate portions 5 is 40 mm, the distance D11 between these and through holes 31 adjacent thereto is 30 mm, and the width D12 of each of the two second face plate portions 5 is 16 mm. This is a large sized ground paper.

The width D13 of the ground paper 1 shown in FIG. 17 is 75 mm, the length D14 of the ground paper 1 is 138 mm, the distance D15 between through holes 31 which should be located on the boundary between the first face plate portion 4 and each of the second face plate portions 5 is 60 mm, the distance D16 between the through holes 31 which face each other is 40 mm, the distance D17 between a set of inner through holes 31 out of the four through holes formed at positions corresponding to the second face plate portiond 5 is 40 mm, the distance D18 between these and through holes 31 adjacent thereto is 30 mm, and the width D19 of each of the two second face plate portions 5 is 16 mm. This is a small-sized ground paper.

The reason for the preparation of three different sized ground papers 1 is that the best ground paper 1 can be selected according to the size and position of a damaged portion to be repaired and the handling ease of an operator.

An imaginary line L in FIG. 7 shows the outline of the above holding plate 2. There are formed two V-shaped cut grooves 12 and 12 which extend linearly in the longitudinal direction of the resin plate from proximal ends T located at inside positions corresponding to approximately ¼ of the total width from both the corners A on the short sides.

The V-shaped cut grooves 12 and 12 form portions where strength lowers locally in the resin plate. That is, they form thin flanges for the resin plate. The thin flange is a moving means of moving part of a desired member by forming a linear thin portion on the desired member as an axis. In this embodiment, the thin portions are formed in the substrate portion 30 by the V-shaped cut grooves 12 and 12 so that part of the substrate portion 30 moves with the two cut grooves 12 and 12 as being boundaries. In this embodiment, the inner side of the two cut grooves 12 and 12 is defined as the first face plate portion 4 and the outer sides of the two cut grooves are defined as the second face plate portions 5.

Dust collection passages 13 formed on the cut grooves 12 and 12 are located at substantially the same positions as the bolt insertion holes 7 formed in the holding plate 2. Therefore, when the holding plate 2 is to be set on the sander 100, the attachment bolts 19 are inserted into the bolt insertion holes 7 in the holding plate 2 which face the dust collection passages 13 from the dust collection passages 13 formed on the cut grooves 12 and 12 to fasten together the holding plate 2 and the sander 100 and to attach the polisher to the movable portion 55 of the sander. Thus, in this embodiment, the polisher can be easily attached to and detached from the existing sander.

A description is subsequently given of the substrate portion 30 having the first face plate portion 4 and the second face plate portions 5 and 5, and the elastic members 3, interposed between the substrate portion 30 and the holding plate 2, for holding the substrate portion 30 to the holding plate 2.

Figure 9:
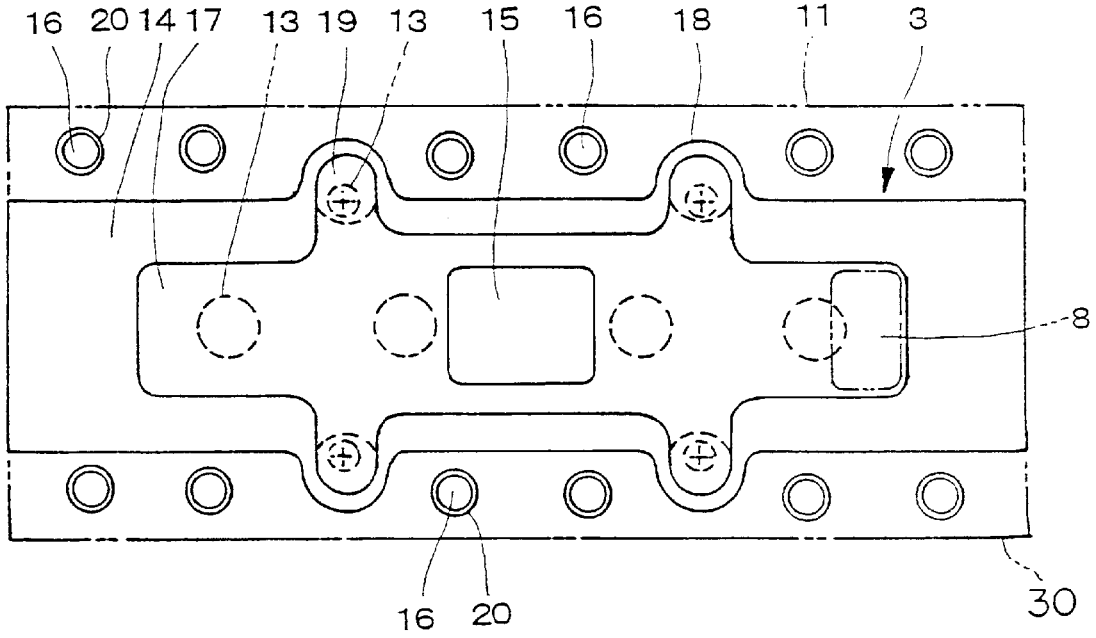
FIG. 9 is a diagram showing the relative positional relationship between the elastic members of the polisher having the ground paper for polishers and dust collection passages according to the embodiment of the present invention.

As shown in FIG. 9, the elastic members 3 consist of a first support member 14 for supporting the periphery of the first face plate portion 4, a second support member 15 for supporting a center portion of the first face plate portion 4 and third support members 16 for supporting the second face plate portions 5 and 5.

The first support member 14 is made of a 6 mm thick hard sponge which is almost the same in size as the first face plate portion 4 and has an inner punched portion 17 formed by punching. The first support member 14 is fixed to the periphery of the resin plate forming the first face plate portion 4 by an adhesive. The size of the punched portion 17 is such as desired by a plurality of dust collection passages 13 formed in the first face plate portion 4 and the second face plate portions 5 and 5.

As for the dust collection passages 13 formed on the boundaries between the first face plate portion 4 and the second face plate portions 5 and 5, that is, across the cut grooves 12, part of the first support member 14 is projected toward the second face plate portions 5 to form bypass portions 18 so that the first support member 14 bypasses the dust collection passages 13. Therefore, the dust collection passages 13 formed on the boundaries between the first face plate portion 4 and the second face plate portions 5 are open to the inside of the punched portion 17 like the dust collection passages 13 arranged in a row substantially at the center of the first face plate portion 4.

The second support member 15 is made of a hard sponge formed as a 6 mm thick rectangle and arranged on the inside of the punched portion 17 of the first support member 14 and substantially at the center of the first face plate portion 4 and supports substantially the center of the first face plate portion 4. The second support member 15 is much smaller than the punched portion 17 of the first support member 14 and arranged not to cover the dust collection passages 13 and the dust collection port 8 all of which are open to the punched portion 17.

The first support member 14 and the second support member 15 are made of a hard sponge having elasticity and have a large support area for the first face plate portion 4. As a result, the first face plate portion 4 is fixed to the holding plate 2.

The third support members 16 consist of a plurality of hard sponges formed cylindrical with a height of 6 mm and a diameter of about 5 mm and coil springs 20 disposed around the respective hard sponges. The hard sponges and the coil springs 20 are provided at the centers of the second face plate portions 5 and 5 in a longitudinal direction at predetermined intervals. They determine the positions of the second face plate portions 5 with respect to the holding plate 2.

The third support members 16 have a much smaller cross section than those of the first support member 14 and the second support member 15 and can be easily bent by fingers. Therefore, the third support members 16 are fixed to such an extent that the second face plate portions 5 can be easily moved with respect to the holding plate 2. That is, the second face plate portions 5 and 5 are fixed to the holding plate 2 by the flexibility of the third support members 16 and connected to the first face plate portion 4 in such a manner that they can rotatable about the cut grooves 12 as rotary axes.

According to the above constitution, when an external force (pressure) is applied to the second faceplate portions 5, the second face plate portions 5 move in a direction that they approach the holding plate and when the external force (pressure) applied to the second face plate portions is removed, the under surfaces of the second face plate portions 5 return in a direction that they become flush with the under surface of the first face plate portion 4. When an external force is kept applied to the second face plate portions 5, parts of the second face plate portions 5 are contacted to side wall portions 9 on the long sides of the holding plate 2, whereby their movable ranges are limited.

The movable ranges of the second face plate portions 5 can be easily altered by changing the heights and angles of the side wall portions 9 of the holding plate 2. They can also be altered by changing the thickness of the hard sponge forming the elastic members 3. When each of the movable ranges is to be set and the polisher is operated within the arbitrarily set movable range, the movable range is set to ensure that a well polished surface can be easily obtained.

A description is subsequently given of the use method and polishing process of the sander 100 equipped with the polisher having the above constitution with reference to FIGS. 10 to 13.

Figure 10:
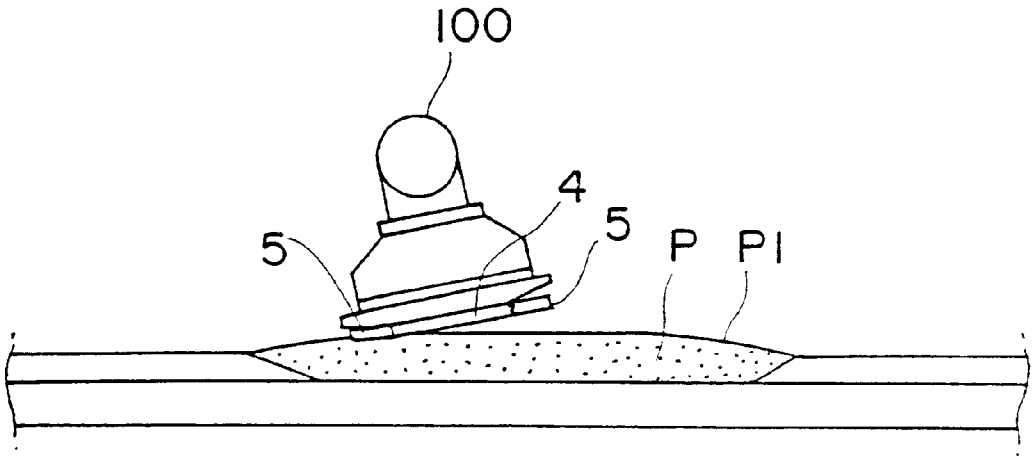
FIG. 10 is a diagram showing use of the polisher having the ground paper for polishers according to the embodiment of the present invention.
Figure 11:
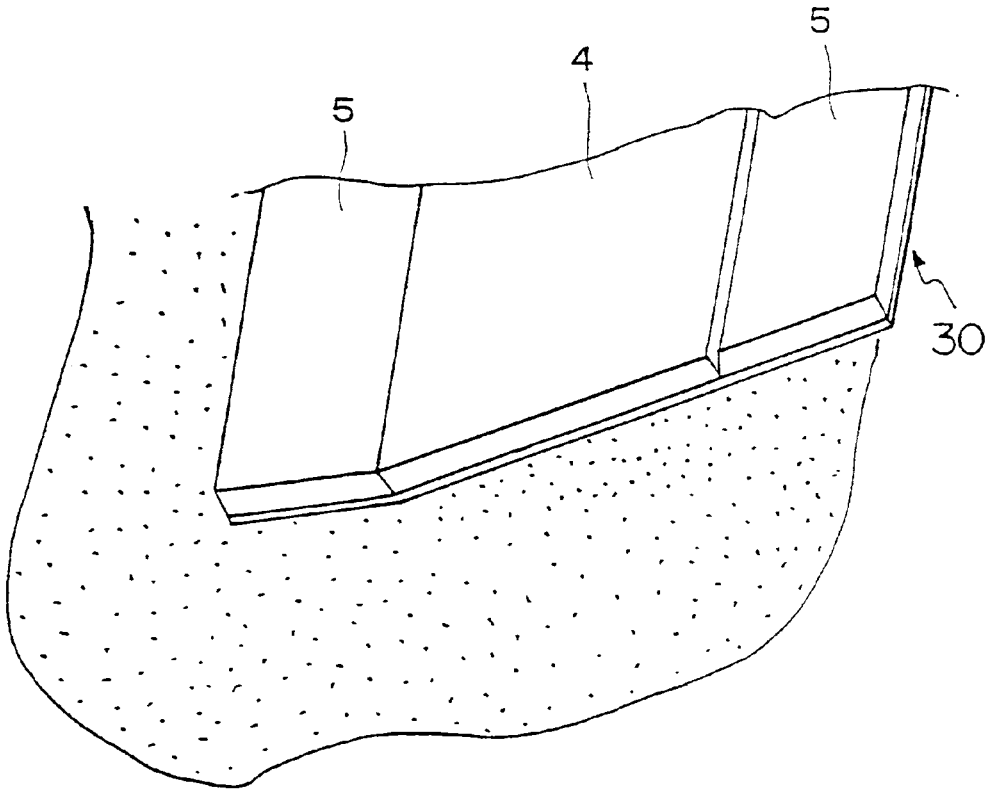
FIG. 11 is an enlarged view of the substrate portion when the polisher having the ground paper for polishers according to the embodiment of the present invention is used.
Figure 22:
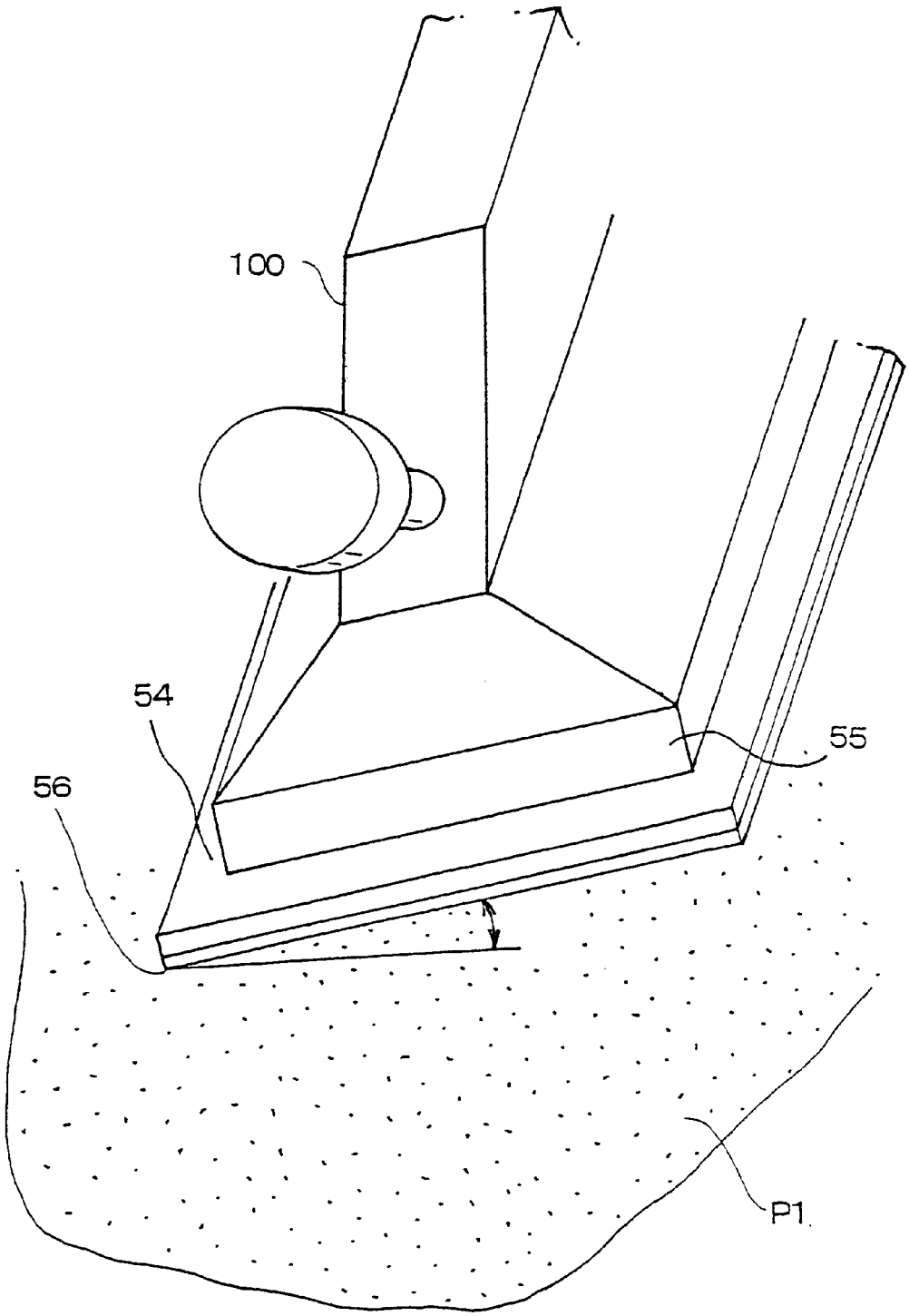
FIG. 22 is a diagram showing use of a polisher of the prior art.

As shown in FIG. 10, the sander 100 is first operated such that only the second face plate portion 5 is contacted to the putty surface P1. That is, linear polishing is carried out with the second face plate portion 5 alone. Since the second face plate portion 5 has a certain width, a stable operation feeling is obtained in spite of linear polishing operation using the edge portion 56 which has been carried out by the prior art method shown in FIG. 22. The local excessive abrasion of the ground paper 1 located at the edge portion of the substrate portion 30 can also be suppressed.

As the second face plate portions 5 are made of a thick resin plate (having a thickness of about 1 to 2 mm), they have flexibility in a direction perpendicular to the longitudinal direction thereof, that is, vertical direction of the substrate portion 30. Therefore, the second face plate portion 5 bends along the undulations of the putty surface P1 and the second face plate portion 5 (ground paper 1) contacts the putty surface P1 uniformly. Therefore, a more stable operation feeling is obtained with the polisher and linear polishing can be carried out efficiently. The flexibility of the second face plate portion 5 is set such that the convex portions of the putty surface P1 can be polished smoothly.

Figure 12:
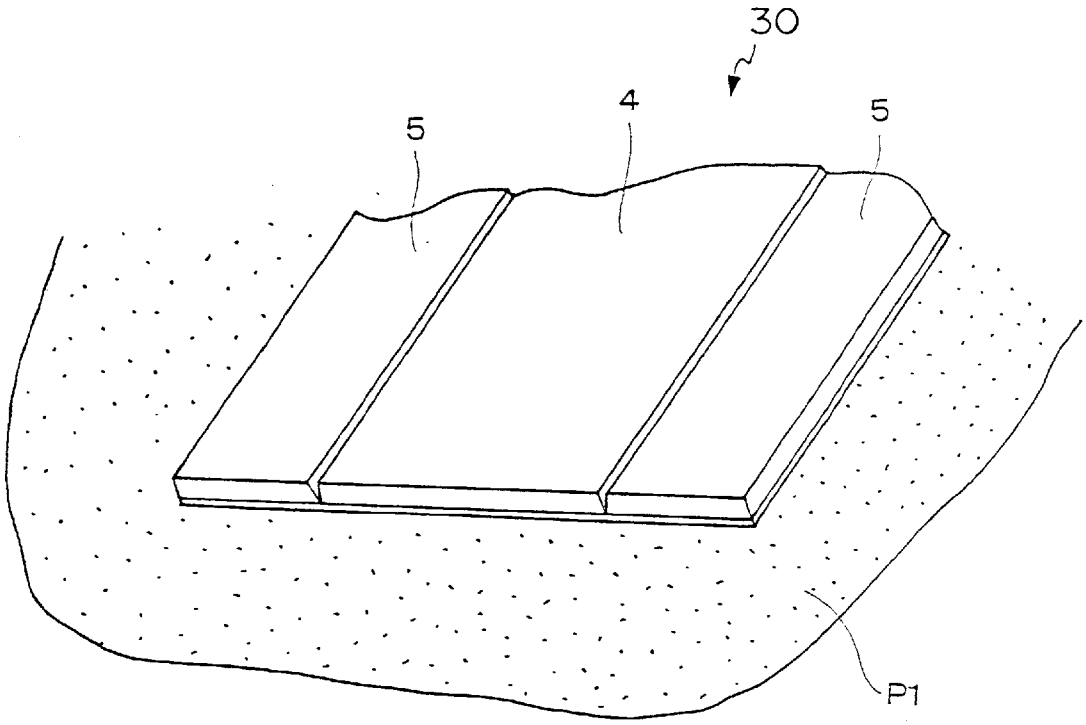
FIG. 12 is an enlarged view of the substrate portion when the polisher having the ground paper for polishers according to the embodiment of the present invention is used.

After linear polishing is carried out with the second face plate portion 5, as shown in FIG. 12, the sander 100 is operated such that both the first face plate portion 4 and the second face plate portions 5 are contacted to the putty surface P1 to carry out face polishing. Thus, by suitably using the surfaces of the substrate portion 30 as polishing surfaces, a satisfactory flat surface can be easily obtained in a short period of time.

Figure 13:
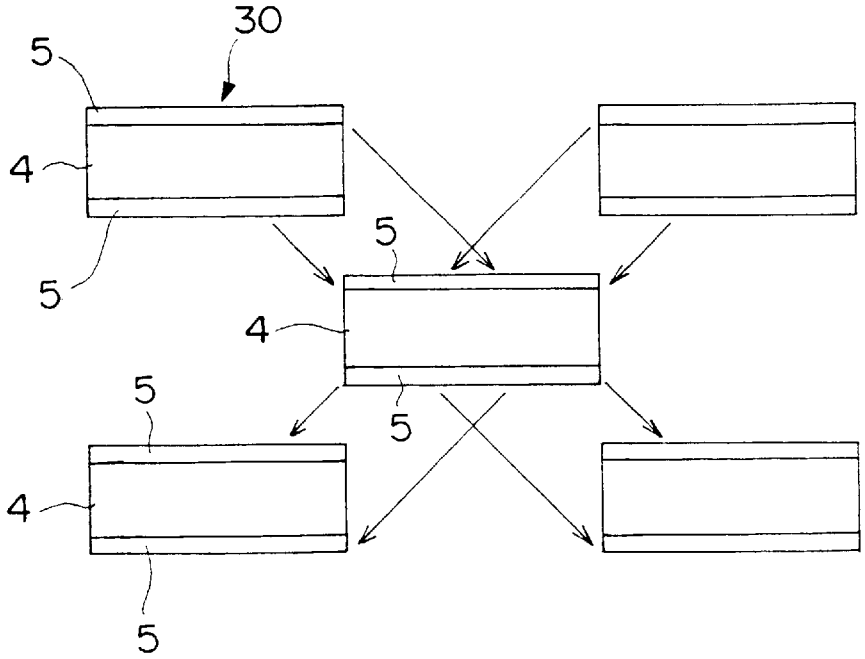
FIG. 13 is a diagram showing the operation directions of the polisher having the ground paper for polishers according to the embodiment of the present invention.
Figure 14:
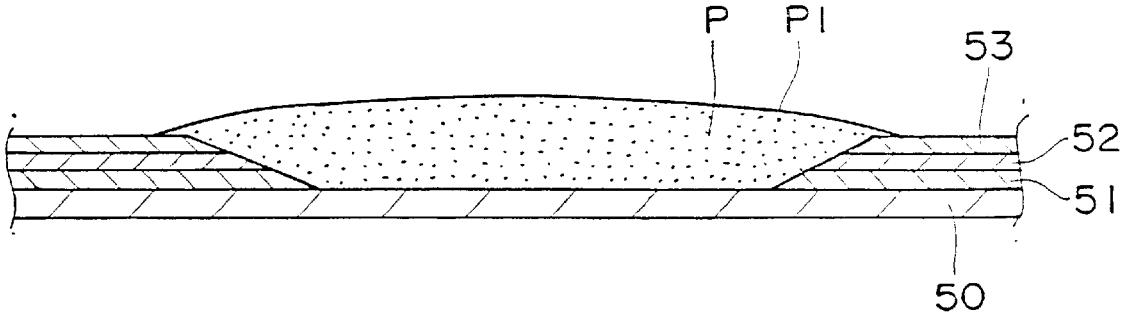
FIG. 14 is a sectional view of a repair surface according to an embodiment of the present invention.

As for the operation direction of the sander 100 for linear polishing and face polishing, for example, polishing is preferably carried out in a cross hand manner as shown in FIG. 13. Polishing may be carried out by selecting the type of sandpaper (ground paper 1) from No. 80 to No. 180 in such a manner that the sandpaper number is increased stepwise according to the situation.

A primer surfacer is applied to the flattened putty surface P1 to form a primer surfacer layer. Preferably, a primer surfacer layer is also formed on a portion around the boundary between the putty and the old coating film. It is recommended to form the primer surfacer layer such that its thickness becomes the largest and fixed at a portion around the boundary between the putty and the old coating film and becomes smaller as the distance from the boundary increases.

The primer surfacer used in this embodiment is preferably a primer surfacer made from an ultraviolet polymerizable composition. A primer surfacer coated surface formed by applying the primer surfacer containing an ultraviolet polymerizable compound is irradiated with ultraviolet light to cure the primer surfacer layer. A coating is applied to the primer surfacer layer to finish the repair of the damaged portion.

Figure 18:
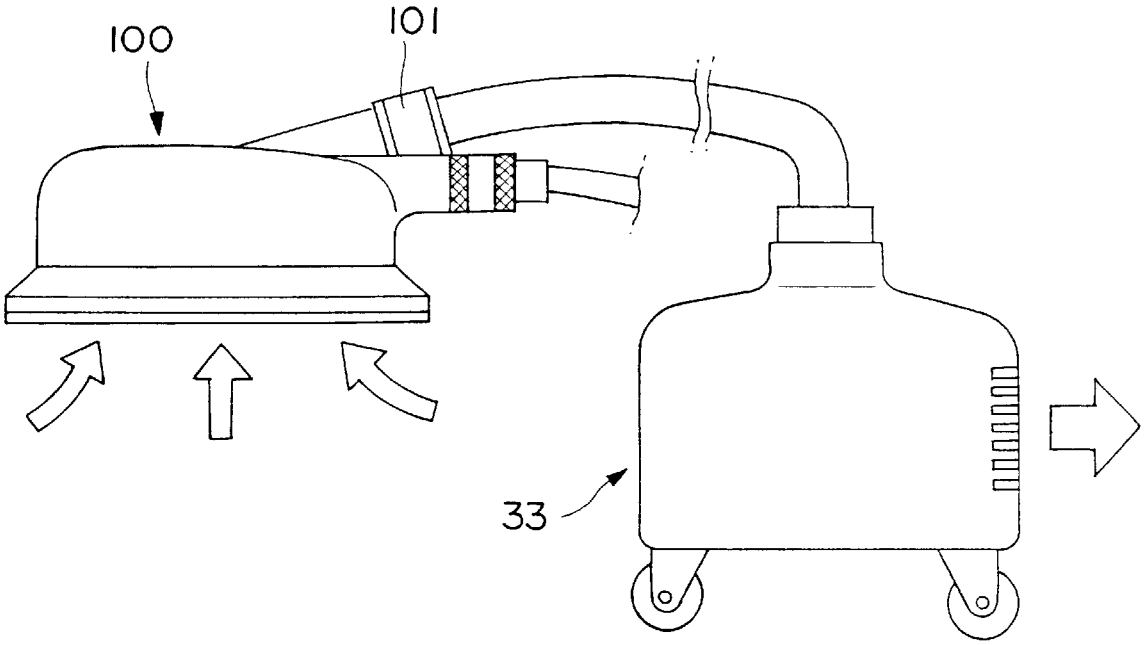
FIG. 18 is a side view of a polisher having the ground paper for polishers and a suction device according to the embodiment of the present invention.
Figure 19:
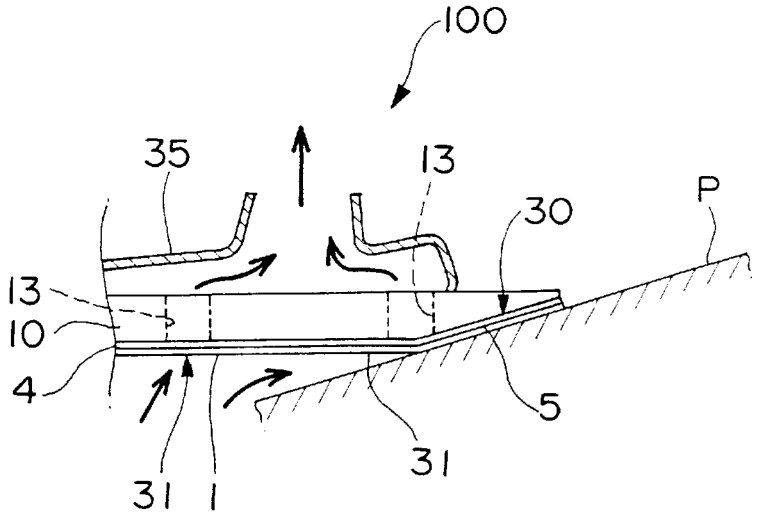
FIG. 19 is a sectional view for explaining that dust is sucked from a portion around the ground paper for polishers according to the embodiment of the present invention.

Dust generated by a set of polishing works is sucked by a dust collector 33 (dust collecting means) shown in FIG. 18. The dust collector 33 is connected to the dust collection passages 13 by a shroud 35 incorporated in the sander 100 and the dust collection passages 13 communicate with the through holes 31. Therefore, dust generated on the ground paper 1 is sucked from the through holes 31 efficiently.

The present invention is not limited to the contents of the above embodiments and one of ordinary skill in the art can make various changes and modifications in the present invention without departing from the spirit and scope as set out in the accompanying claims.

What is claimed is:

1. A polisher, comprising: a substrate portion for holding an abrasive on a surface opposite to a repair surface; a holding plate provided in parallel to the substrate portion with a predetermined space therebetween; and elastic members interposed between the substrate portion and the holding plate, wherein:

the substrate portion has a first face plate portion fixed to the above holding plate with a predetermined space therebetween and second face plate portions, which are connected to respective end portions of the first face plate portion and are rotatable about connection lines as axes, connecting them and the first face plate portion; and the second face plate portions is rotatable provided in a predetermined range from a position where they become flush with the first face plate portion in a direction that they approach the holding plate.

2. The polisher according to claim 1, wherein the second face plate portions are urged in a direction that they become flush with the first face plate portion from the holding plate side by the elasticity of the elastic members located between the holding plate and the second face plate portions.

3. The polisher according to claim 1, wherein the first face plate portion and the second face plate portions are formed rectangular and the long sides of the second face plate portions are connected to the respective long sides of the first face plate portion.

4. The polisher according to claim 3, wherein the second face plate portions connected to the respective long sides of the first face plate portion are provided on both of the long sides of the first face plate portion.

5. The polisher according to claim 3, wherein the second face plate portions have flexibility in a direction perpendicular to their longitudinal directions.

6. The polisher according to claim 5, wherein a plurality of elastic members are provided in the longitudinal direction of the holding plate at predetermined intervals and the second face plate portion having flexibility are supported by the plurality of elastic members.

7. The polisher according to claim 1, wherein the second face plate portions have a smaller surface area than the surface area of the first face plate portion.

8. The polisher of according to claim 1, wherein the movable range of each of the second face plate portions is set to a range from a position where it becomes flush with the first face plate portion to a position where a part of the second face plate portion contacts the side edge of the holding plate.

9. The polisher of according to claim 1, wherein the holding plate can be attached to and detached from the movable portion of a mechanical sander having the movable portion which makes reciprocation along the repair surface.

10. The polisher of according to claim 1, wherein a dust collection means having dust collection passages extending through the substrate portion, the elastic members and the holding plate is provided and connected to a suction device using as an air suction source negative pressure.

11. A ground paper for polishing suitable for use in a polisher, comprising: a substrate portion having a first face plate portion and second face plate portions connected to respective end portions of the first face plate portion and moving about connection lines as axes connecting them and the first face plate portion, wherein: the second face plate portions are rotatably provided in a predetermined range from a position where they become flush with the first face plate portion; and this ground paper is adhered to a surface facing a repair surface of the substrate portion, a plurality of through holes are formed in the ground paper, and some of the through holes are located at positions corresponding to the boundaries between the first face plate portion and the second face plate portions.

12. The ground paper for polishing according to claim 11, wherein some of the through holes are screw holes for attaching the ground paper to the first face plate portion.

13. The ground paper for polishing according to claim 11, wherein dust collection passages formed in the first and second face plate portions at positions corresponding to the through holes of the ground paper and a dust collection means is connected to the dust collection passages.

14. The ground paper for polishing of according to claim 11, wherein the through holes located at positions corresponding to the boundaries between the first face plate portion and the second face plate portions are formed at positions for dividing the longitudinal direction of the ground paper into almost three sections.

15. The polishing ground paper of according to claim 11, wherein the through holes located at positions corresponding to the first face plate portion are formed at positions for dividing the longitudinal direction of the substrate portion into almost 4 to 8 sections.

* * * * *

US006419571C1

(12) EX PARTE REEXAMINATION CERTIFICATE (4956th)

United States Patent

Ueno

(10) Number: US 6,419,571 C1

(45) Certificate Issued: Jun. 29, 2004

(54) POLISHER AND GROUND PAPER FOR POLISHERS

(75) Inventor: Makoto Ueno, Miyagi (JP)

(73) Assignee: Tateo Uegaki, Sendai (JP)

Reexamination Request:
No. 90/006,559, Mar. 6, 2003

Reexamination Certificate for:

| | |
|---|---|
| Patent No.: | **6,419,571** |
| Issued: | **Jul. 16, 2002** |
| Appl. No.: | **09/761,866** |
| Filed: | **Jan. 17, 2001** |

(30) Foreign Application Priority Data

Jan. 18, 2000 (JP) ..... 2000-013984

(51) Int. Cl.[7] ..... B24B 15/00

(52) U.S. Cl. ..... 451/523; 451/495; 451/524; 451/514; 451/396; 451/525; 451/526; 451/530; 451/539; 451/913

(58) Field of Search ..... 451/523, 495, 451/524, 525, 526, 530, 539, 913, 514, 356, 529

(56) References Cited

U.S. PATENT DOCUMENTS

| | | | | |
|---|---|---|---|---|
| 1,405,308 A | * | 1/1922 | Matrazzo | 451/356 |
| 2,260,644 A | * | 10/1941 | Siebert et al. | 451/511 |
| 3,704,559 A | | 12/1972 | Morgan | |
| 3,932,966 A | | 1/1976 | Stern | |
| 6,220,948 B1 | * | 4/2001 | Carballo | 451/356 |
| 6,406,365 B1 | * | 6/2002 | Ueno | 451/523 |

FOREIGN PATENT DOCUMENTS

| | | |
|---|---|---|
| JP | 55-45411 | 3/1980 |

* cited by examiner

*Primary Examiner*—M. Rachuba

(57) ABSTRACT

A polisher for polishing a repair surface to a predetermined shape and a ground paper for polishers are provided. The polisher of the present invention includes a substrate portion (30) for holding an abrasive on a surface opposite to a repair surface, a holding plate (2) provided in parallel to the substrate portion with a predetermined space therebetween, and elastic members (3) interposed between the substrate portion (30) and the holding plate (2). The substrate portion (30) has a first face plate portion (4) fixed to the holding plate (2) with a predetermined space therebetween and second face plate portions (5) which are connected to respective end portions of the first place portion (4) and are rotatable about connection lines as axes, connecting them and the first face plate portion (4). The second face plate portions (5) are rotatably provided in a predetermined range from a position where they become flush with the first face plate portion (4) in a direction that they approach the holding plate (2). The ground paper for polishers of the present invention is adhered to a surface facing the repair surface of the substrate portion (30), a plurality of through holes (31) are formed in the ground paper, and some of the through holes are located at positions corresponding to the boundaries between the first face plate portion (4) and the second face plate portions (5). According to the present invention, there are provided a polisher which can polish the repair surface flat by simple operation and a ground paper for polishers.

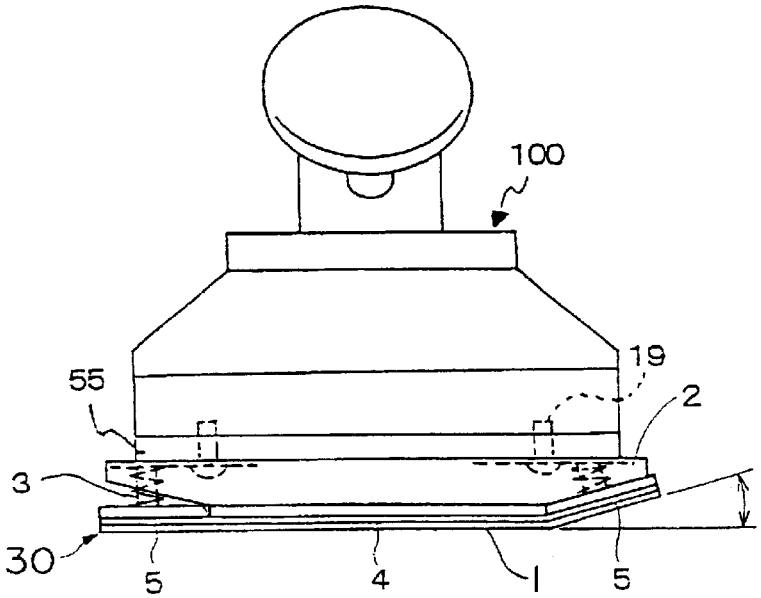

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *